US010128073B2

(12) United States Patent
Puhalla et al.

(10) Patent No.: US 10,128,073 B2
(45) Date of Patent: Nov. 13, 2018

(54) ELECTRICAL SWITCHING APPARATUS AND THERMAL TRIP ASSEMBLY THEREFOR

(71) Applicant: EATON CORPORATION, Cleveland, OH (US)

(72) Inventors: Craig Joseph Puhalla, Moon Township, PA (US); Brian Scott Jansto, Beaver Falls, PA (US); Richard Paul Malingowski, McDonald, PA (US); James Patrick Sisley, Baden, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/387,717

(22) Filed: Dec. 22, 2016

(65) Prior Publication Data

US 2018/0182582 A1 Jun. 28, 2018

(51) Int. Cl.

| | |
|---|---|
| ***H01H 37/52*** | (2006.01) |
| ***H01H 37/12*** | (2006.01) |
| ***H01H 71/16*** | (2006.01) |
| ***H01H 71/40*** | (2006.01) |
| *H01H 73/50* | (2006.01) |

(52) U.S. Cl.

CPC ..... *H01H 37/52* (2013.01); *H01H 37/12* (2013.01); *H01H 71/164* (2013.01); *H01H 71/40* (2013.01); *H01H 73/50* (2013.01)

(58) Field of Classification Search

CPC ..... H01H 37/12; H01H 37/16; H01H 37/20; H01H 37/52; H01H 71/7436; H01H 71/40; H01H 71/164; H01H 73/50

USPC ..... 337/360

See application file for complete search history.

(56) References Cited

U.S. PATENT DOCUMENTS

| | | | | |
|---|---|---|---|---|
| 3,116,388 A | | 12/1963 | Hobson, Jr. | |
| 3,313,898 A | * | 4/1967 | Owen | H01H 71/121 337/103 |
| 3,866,156 A | * | 2/1975 | DiMarco | H01H 71/04 337/376 |
| 5,831,501 A | * | 11/1998 | Kolberg | H01H 71/7463 335/176 |

(Continued)

FOREIGN PATENT DOCUMENTS

| | | |
|---|---|---|
| DE | 10 2006 005 697 A1 | 8/2007 |
| EP | 2 472 549 A1 | 7/2012 |
| EP | 2 560 184 A2 | 2/2013 |

OTHER PUBLICATIONS

European Patent Office, "International Search Report and Written Opinion", PCT/US2017/066934, dated Apr. 3, 2018, 12 pp.

*Primary Examiner* — Anatoly Vortman
*Assistant Examiner* — Jacob Crum
(74) *Attorney, Agent, or Firm* — Eckert Seamans

(57) ABSTRACT

A thermal trip assembly is for an electrical switching apparatus. The electrical switching apparatus includes a housing, separable contacts enclosed by the housing, an operating mechanism for opening and closing the separable contacts, and a number of shunts. The thermal trip assembly includes a load conductor, a bimetal adapted to cooperate with the operating mechanism to open the separable contacts in response to a trip condition, and a bypass heater element structured to be electrically connected to the shunts. The bypass heater element directs the flow of electric current to at least partially bypass the bimetal.

16 Claims, 5 Drawing Sheets

(56) References Cited

U.S. PATENT DOCUMENTS

| | | | | |
|---|---|---|---|---|
| 6,225,882 | B1 * | 5/2001 | Hood | H01H 71/0214 335/172 |
| 6,323,748 | B1 * | 11/2001 | Malingowski | H01H 3/04 335/172 |
| 6,633,211 | B1 * | 10/2003 | Zindler | H01H 71/2472 335/35 |
| 6,788,174 | B1 * | 9/2004 | Afshari | H01H 71/2472 335/176 |
| 6,801,110 | B2 * | 10/2004 | Kolberg | H01H 1/5822 335/172 |
| 7,800,478 | B2 | 9/2010 | Puhalla et al. | |

* cited by examiner

ELECTRICAL SWITCHING APPARATUS AND THERMAL TRIP ASSEMBLY THEREFOR

BACKGROUND

Field

The disclosed concept relates generally to electrical switching apparatus and, more particularly, to electrical switching apparatus, such as circuit breakers. The disclosed concept also relates to thermal trip assemblies for electrical switching apparatus.

Background Information

Electrical switching apparatus, such as circuit breakers, are known to be employed in electrical systems to protect a portion of a circuit during certain predetermined conditions such as, for example, in response to a trip condition (e.g., without limitation, an overcurrent condition; a relatively high level short circuit or fault condition; a ground fault or arc fault condition).

Relatively small molded case circuit breakers, for example, typically include one or more trip devices such as a magnetic trip assembly, a thermal trip assembly, etc., each of which cooperates with an operating mechanism that is configured to move at least one pair of separable contacts of the circuit breaker between an ON condition and a TRIPPED or an OFF condition when one or more of the predetermined conditions in the protected circuit are met. Each pair of separable contacts includes a stationary contact and a movable contact disposed on a corresponding movable (e.g., pivotable) contact arm. The operating mechanism is typically electrically connected to the thermal trip assembly by a number of flexible conductors or shunts.

Thermal trip assemblies typically include a bimetal and a number of heater elements. In operation, for example in response to an overload condition, electric current drawn by the load heats the heater elements which, in turn, heat the bimetal causing it to move (e.g., bend) and thereby, directly or indirectly, cooperate with a trip bar of the operating mechanism causing the trip bar to move (e.g., pivot) thereby pivoting the attached movable contact arm(s) and tripping open (e.g., separating) the separable contacts of the circuit breaker and interrupting the flow of electric current. Thus, the thermal trip assembly functions to provide a thermal trip response that is directly related to the magnitude of current drawn by the load. While such trip devices have been generally effective for their intended purposes, they have not been without limitations. For example, resistive forces from the shunt(s) on the bimetal can cause undesirable issues with respect to tripping of the circuit breaker. Potential for excessive heat to be generated by the bimetal can also be a cause for concern. Further, various factors, such as limited available space within the circuit breaker housing, present design challenges with respect to the structure, location and function or operation of the shunt(s), load conductor(s) and/or other components.

There is, therefore, room for improvement in electrical switching apparatus and in thermal trip assemblies therefor.

SUMMARY

These needs and others are met by embodiments of the disclosed concept, which are directed to an electrical switching apparatus and a thermal trip assembly therefor, which among other benefits, is designed to indirectly heat the bimetal of the thermal trip assembly.

As one aspect of the disclosed concept, a thermal trip assembly is provided for an electrical switching apparatus. The electrical switching apparatus includes a housing, separable contacts enclosed by the housing, an operating mechanism for opening and closing the separable contacts, and a number of shunts. The thermal trip assembly comprises: a load conductor; a bimetal adapted to cooperate with the operating mechanism to open the separable contacts in response to a trip condition; and a bypass heater element structured to be electrically connected to the shunts. The bypass heater element directs the flow of electric current to at least partially bypass the bimetal.

An electrical switching apparatus including the aforementioned thermal trip assembly is also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
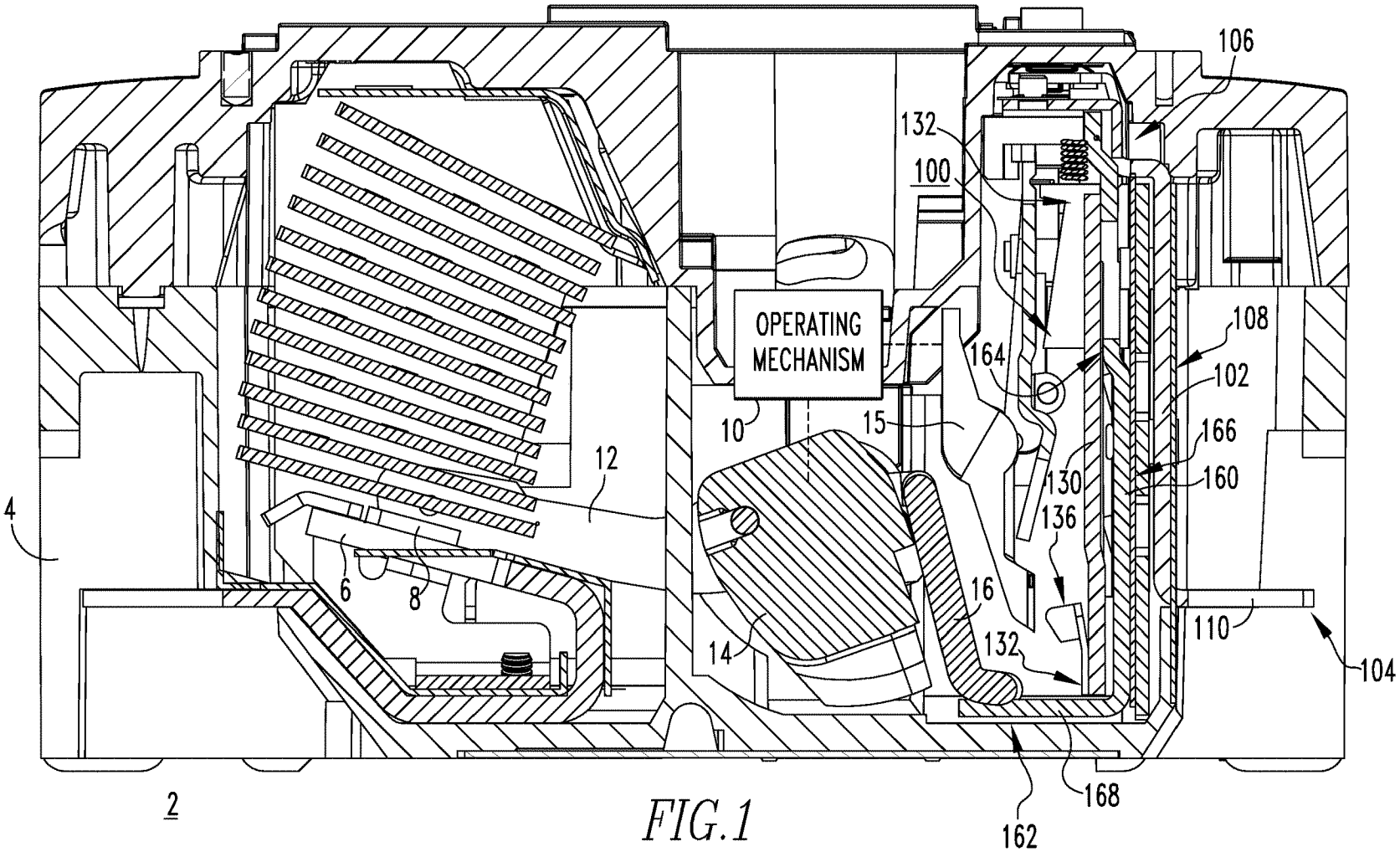
FIG. 1 is a side elevation section view of a circuit breaker and thermal trip assembly therefor in accordance with a non-limiting embodiment of the disclosed concept.

The disclosed concept may take form in various components and arrangements of components, and in various techniques, methods, or procedures and arrangements of steps. The referenced drawings are only for the purpose of illustrated embodiments, and are not to be construed as limiting the present invention. Various inventive features are described below that can each be used independently of one another or in combination with other features.

Directional phrases used herein, such as, for example, left, right, front, back, top, bottom, clockwise, counter-clockwise, and derivatives thereof, relate to the orientation of the elements shown in the drawings and are not limiting upon the claims unless expressly recited therein.

As employed herein, the singular form of "a", "an", and "the" include plural references unless the context clearly dictates otherwise. Still further, as used herein, the term "number" shall mean one or an integer greater than one (e.g., a plurality).

As employed herein, the term "coupled" shall mean that two or more parts are joined together directly or joined through one or more intermediate parts. Furthermore, as employed herein, the phrases "directly connected" or "directly electronically connected" shall mean that two or more parts are joined together directly, without any intermediate parts being disposed therebetween at the point or location of the connection.

As employed herein, the phrase "electrically connected" shall mean that two or more parts or components are joined together either directly or joined through one or more intermediate parts such that electricity, current, voltage, and/or energy is operable to flow from one part or component to the other part or component, and vice versa.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

FIG. 1 shows an electrical switching apparatus, such as for example and without limitation, a molded case circuit breaker 2, which employs a thermal trip assembly 100 in accordance with a non-limiting example embodiment of the disclosed concept. In the example of FIG. 1, the circuit breaker 2 includes a housing 4, separable contacts 6, 8 enclosed by the housing, and an operating mechanism 10 (shown in simplified form in FIG. 1 cooperating with cross bar 14 and trip bar 15) for opening and closing the separable contacts 6, 8. More specifically, the separable contacts 6, 8 include a stationary contact 6 and a movable contact 8, which is disposed on a corresponding movable (e.g., pivotable) contact arm 12 (see also movable contact arm 12' of FIGS. 6 and 7). The movable contact arm 12 extends outwardly from a cross bar 14 (partially shown in section view in FIG. 1) and is pivotable with the cross bar 14 in a well known manner, for example, in response to a trip condition. The circuit breaker 2 also includes a number of shunts 16 (one shunt 16 is shown in section view in FIG. 1; see also shunt 16 of FIGS. 2 and 3, and shunt 16 of FIGS. 4-7), which electrically connect the operating mechanism 10 to the thermal trip assemble 100.

Figure 2:
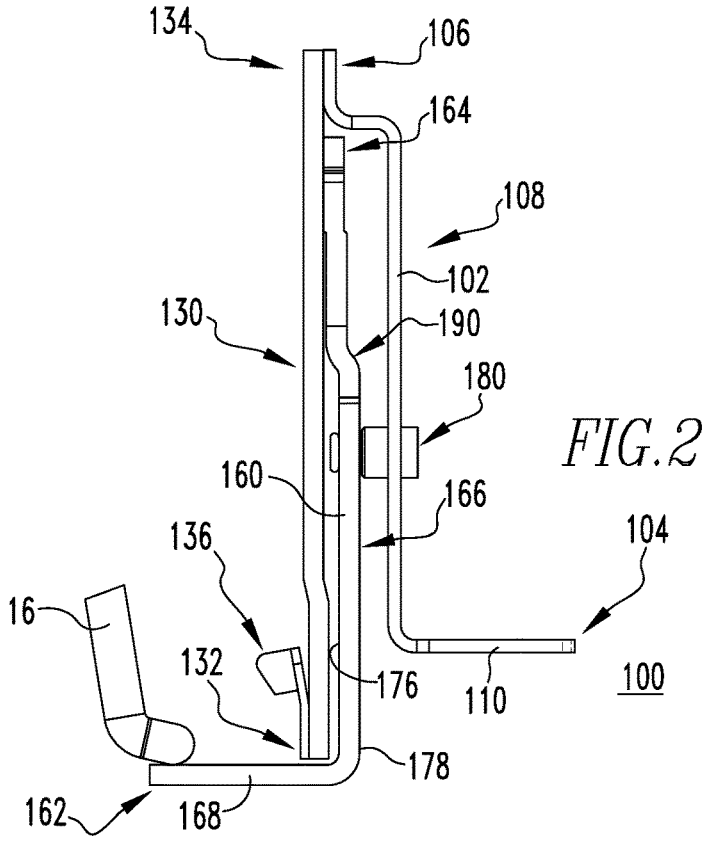
FIG. 2 is a side elevation view of the thermal trip assembly of FIG. 1.
Figure 3:
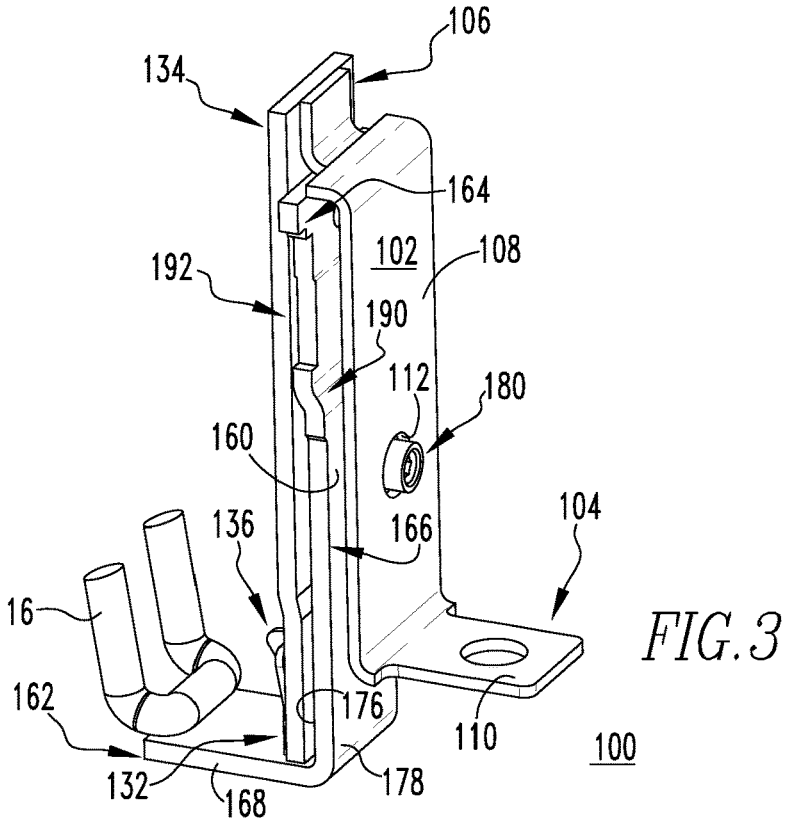
FIG. 3 is an isometric view of the thermal trip assembly of FIG. 2.

Continuing to refer to FIG. 1, and also to FIGS. 2 and 3, it will be appreciated that the trip assembly 100 generally includes a load conductor 102, a bimetal 130, and a bypass heater element 160. The bimetal 130 is adapted to cooperate with the circuit breaker operating mechanism 10 (FIG. 1) to open the separable contacts 6, 8 (FIG. 1) in response to the trip condition. The bypass heater element 160 is structured to be electrically connected to the aforementioned shunt(s) 16 (partially shown in FIGS. 2 and 3). Accordingly, as will be discussed in further detail herein, the bypass heater element 160 is adapted to direct the flow of electric current to at least partially bypass the bimetal 130. In doing so, the bypass heater element 160 affords the thermal trip assembly 100 a number of advantages. Among other benefits, because the bypass heater element 160 directs the flow of electric current to at least partially, if not entirely bypass bimetal 130, the amount of heat generated by the bimetal 130 is advantageously reduced. This is accomplished by limiting or eliminating the current flow that passes directly through the bimetal generating heat. This, in turn, allows for a relatively smaller shunt design. It also allows for existing cross bars (e.g. without limitation, cross bar 14 of FIG. 1) to be used. Further, better shunt control and placement of the shunts 16 away from the trip bar 15 (FIG. 1) can be achieved, and resistive forces from the shunts 16 on the bimetal 130 are reduced or eliminated. In other words, in accordance with the disclosed concept, a thermal trip assemble 100 is provided wherein the bimetal 130 (see also bimetal 230 of FIGS. 4-7) is heated indirectly, because the bypass heater element 160 (see also bypass heater element 260 of FIGS. 4-7) directs current to flow through the bypass heater element 160, 260 and thereby at least partially avoid (i.e., bypass) flowing through the bimetal 130, 230.

The bypass heater element 160 of the thermal trip assembly 100 in the example of FIGS. 1-3 includes first and second opposing ends 162, 164, and an intermediate portion 166 extending therebetween. The first end 162 extends perpendicularly outwardly from the intermediate portion 166 to form a flange 168. The flange 168 is structured to be electrically connected to the aforementioned shunt(s) 16. The load conductor 102 also includes first and second ends 104, 106 and an intermediate portion 108 extending therebetween. The first end 104 of the load conductor 102 extends perpendicularly outwardly from the intermediate portion 108 of the load conductor 102 to form a flange 110, which is disposed in a direction generally opposite the flange 168 of the bypass heater element 160, as best shown in FIG. 2.

As shown in FIG. 3, the load conductor 102 of the non-limiting example thermal trip assembly 100 further includes a thru hole 112, which extends through the intermediate portion 108 of the load conductor 102. The bypass heater element 160 further includes an aperture (hidden in FIG. 3, but see aperture 270 in FIGS. 6 and 7) and an adjustment mechanism 180. It will be appreciated that, although hidden from view, the thermal trip assembly 100 of FIGS. 1-3 includes an aperture (not visible) that is substantially identical to the aperture 270 shown in FIGS. 6 and 7. Accordingly for economy of disclosure, the shape of the aperture 270 as it applies to the embodiment of FIG. 1-3 will be described with respect to the embodiment of FIGS. 4-7 (best shown in FIGS. 6 and 7). Such aperture 270 extends through the intermediate portion 266 of the heater element 260, as shown in FIGS. 6 and 7.

Figure 6:
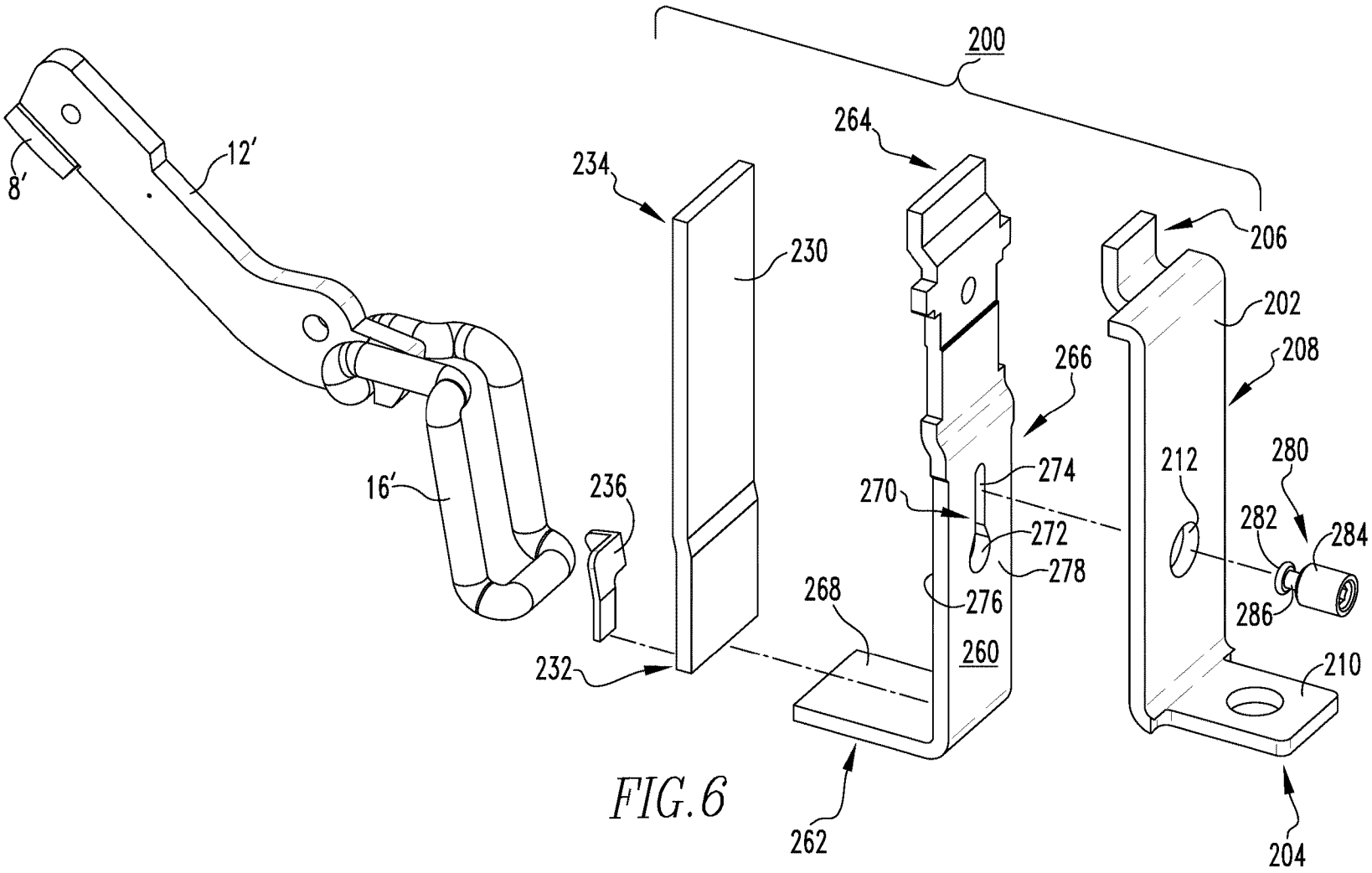
FIG. 6 is an exploded isometric view of the thermal trip assembly of FIG. 5.
Figure 7:
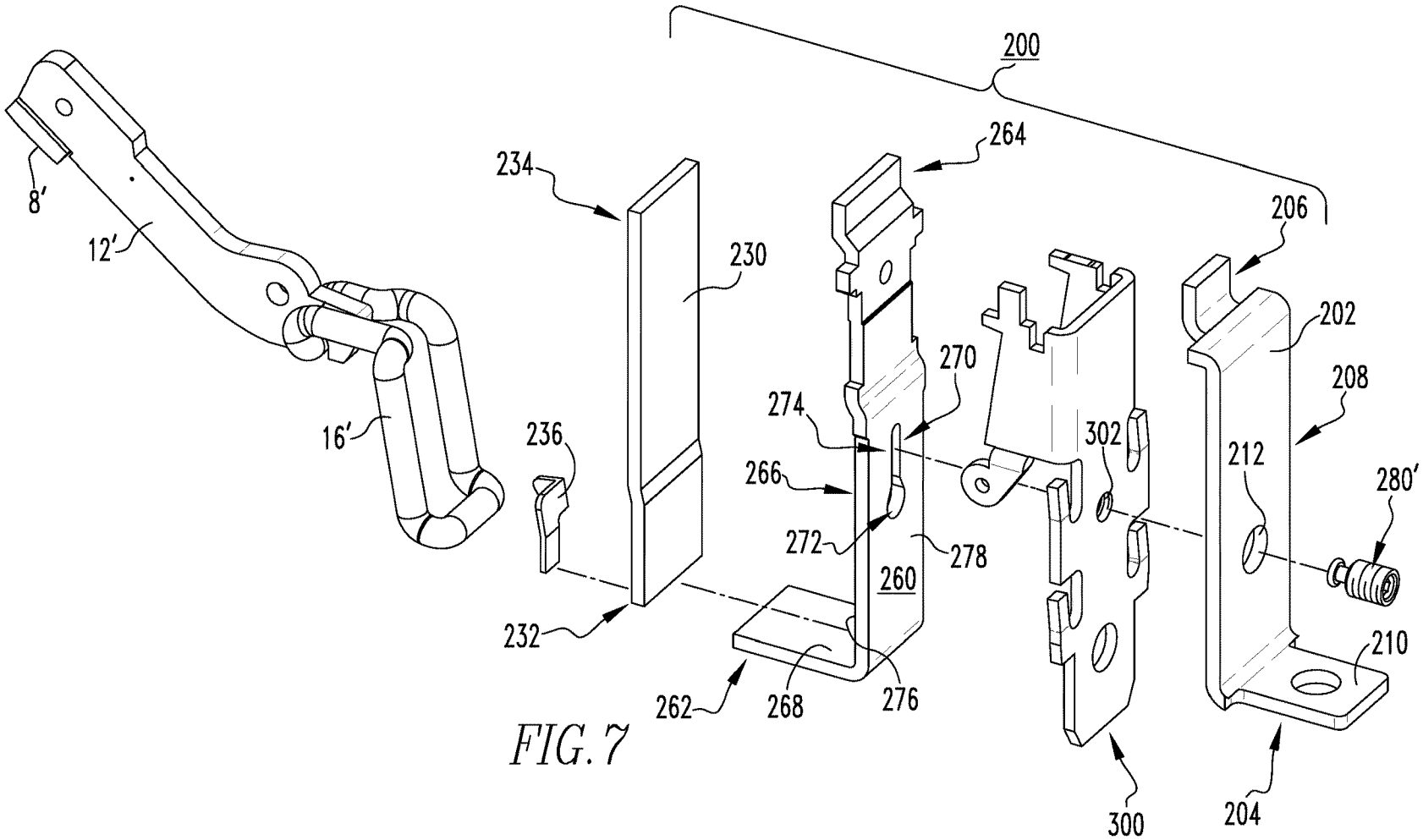
FIG. 7 is another exploded isometric view of the thermal trip assembly of FIG. 6, modified to show a mounting element in accordance with an embodiment of the disclosed concept.

As shown in FIG. 7, a mounting element 300 may optionally be included. For example and without limitation, the mounting element 300 may comprise a portion of a magnetic trip assembly (not shown) for the circuit breaker 2 (FIG. 1). In the non-limiting example FIG. 7, the mounting element 300 is generally disposed between the bypass heater element 260 and the load conductor 202, and includes a threaded aperture 302. In the embodiments shown and described herein, the adjustment mechanism is a thermal calibration screw 180 (FIGS. 2 and 3), 280 (FIGS. 4-6), 280' (FIG. 7). The aperture 270 in the bypass heater element 260 includes an enlarged portion 270 and an elongated portion 274, which extends from the enlarged portion 272 towards the second end 264 of the bypass heater element 260, thereby forming a keyhole-shaped aperture 270, as shown in FIGS. 6 and 7. The thermal calibration screw 280' comprises a head portion 282, a threaded body portion 284, and a neck portion 286 extending between the head portion 282 and threaded body portion 284. The head portion 282 is structured to extend through the enlarged portion 272 of the aperture 270 and be disposed on the first side 276 of the bypass heater element 260. The neck portion 286 is structured to slide within the elongated portion 274 of the aperture 270. The threaded body portion 284 is adjustably secured within the threaded aperture 302 of the mounting element 300 on the second side 278 of the bypass heater element 260. Accordingly, as shown in FIGS. 4 and 5, the head portion 282 of the thermal calibration screw 280 is disposed on the first side 276 of the bypass heater element 260, the neck portion 286 (shown in hidden line drawing in FIG. 4) extends through the bypass heater element 260 within the elongated portion 274 of aperture 270 (both shown in FIGS. 6 and 7), and the threaded body portion 284 extends outwardly from the second side 278 of the bypass heater element 260 and through the thru hole 212 of the load conductor 202, as best shown in FIG. 5.

Figure 4:
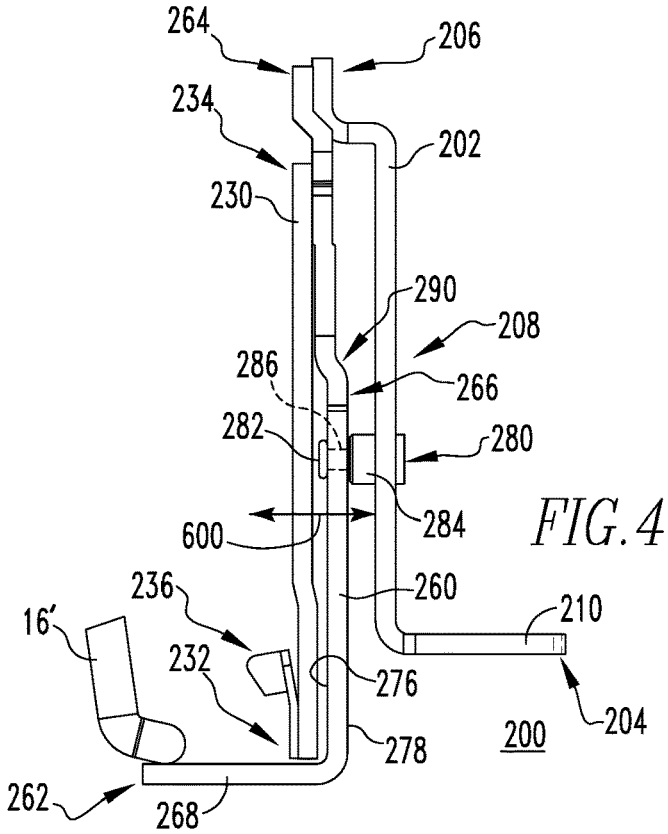
FIG. 4 is a side elevation view of a thermal trip assembly in accordance with another non-limiting embodiment of the disclosed concept.
Figure 5:
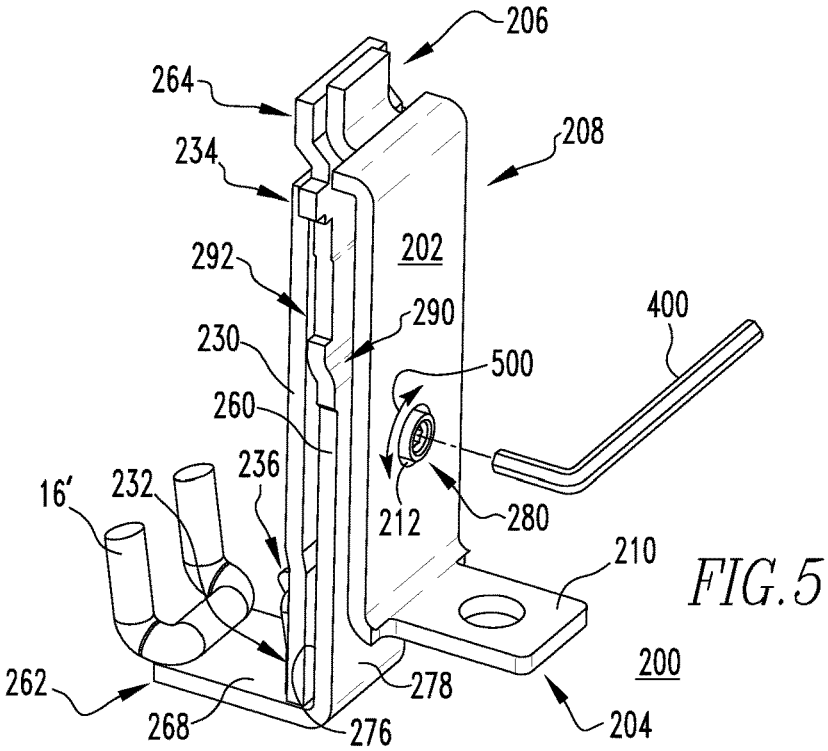
FIG. 5 is an isometric view of the thermal trip assembly of FIG. 4.

It will be appreciated that the optional aforementioned mounting element 300 is shown in FIG. 7 but not in FIGS. 4-6. Referring to FIG. 5, for example, it will be appreciated that, in operation, the thermal calibration screw 280 can be adjusted (e.g., turned in the direction of the arrow 500 (e.g., clockwise or counter clockwise from the perspective of FIG. 5)). Adjusting the thermal calibration screw 280 in this manner can be accomplished using any known or suitable tool such as, for example and without limitation, the Allen wrench 400, shown in FIG. 5. Thus, the thermal calibration screw 280 can be adjusted in the direction of arrow 600 of FIG. 4 (e.g., left and right from the perspective of FIG. 4), in order to push or pull the bypass heater element 260, as desired, which causes the bimetal 230 to move farther or closer to the circuit breaker trip bar 14 (FIG. 1) in order to achieve desired thermal calibration timing.

The two illustrated non-limiting example alternative embodiments of the disclosed concept will now be described. Specifically, FIGS. 1-3 illustrate one non-limiting embodiment of a thermal trip assembly 100, wherein the bypass heater element 160 is structured to direct electric current to partially bypass the bimetal 130, whereas FIGS. 4-7 illustrate an alternative non-limiting embodiment of a thermal trip embodiment 200, wherein the bypass heater element 260 is structured to direct electric current to completely bypass the bimetal 230.

In the partial bypass embodiment illustrated in FIGS. 1-3, the bimetal 130 includes first and second opposing ends 132, 134, and a trigger element 136 disposed at or about the first end 132. In response to the trip condition, the bimetal 130 is adapted to bend, in order that the trigger element 136 cooperates with the operating mechanism 10 (FIG. 1) to trip open the separable contacts 6, 8 (FIG. 1) of the circuit breaker 2 (FIG. 1) in a generally well know manner. The second end 106 of the load conductor 102 is directly electrically connected to the second end 134 of the bimetal 130, as best shown in FIGS. 2 and 3. It will be appreciated that the second ends 106 and 134 of the load conductor 102 and bimetal 130, respectively, can be jointed at this location in any known or suitable manner (e.g., without limitation, welding). Continuing to refer to FIGS. 2 and 3, the second end 164 of the bypass heater element 160 is disposed proximate the second end 134 of the bimetal 130 as well as the second end 106 of the load conductor 102, but is not directly electrically connected to load conductor 102. Accordingly, the bypass heater element 160 functions to partially bypass the bimetal 130, by directing electric current in a desired manner through the bypass heater element 160 to the load conductor 102.

By contrast, the thermal trip assembly 200 shown in the example of FIGS. 4-7 is structured to direct electric current to completely bypass the bimetal 230. The bypass heater element 260 of thermal trip assembly 200 includes first and second ends 262, 264, an intermediate portion 266 extending therebetween, with the first end 262 extending outwardly from the intermediate portion 266 in a perpendicular manner to form a flange 268 structured to be electronically connected to shunts 16', as shown. The load conductor 202 of thermal trip assembly 200 also includes first and second ends 204, 206 and an intermediation portion 208 extending therebetween. The first end 204 extends perpendicularly outwardly from the intermediate portion 208 of load conductor 202 to form a flange 210 disposed in a direction generally opposite flange 268 of the bypass heater element 260. The thru hole 212 of the load conductor 202, keyhole-shaped aperture 270 of the bypass heater element 260, and thermal calibration screw 280 have all been previously described. Referring to FIG. 6, it will be appreciated that bimetal 230, similar to bimetal 130 previously discussed with respect to the embodiment of FIGS. 1-3, has a second end 232 with a trigger element 236 structured to cooperate with the circuit breaker operating mechanism 10 (FIG. 1) in a generally well know manner.

The key distinction of the thermal trip assembly 200 compared to thermal trip assembly 100 is that the second end 264 of the bypass heater element 260 extends beyond the second end 234 of the bimetal 230. Accordingly, it will be appreciated that, unlike in the thermal trip assemble 100 of FIGS. 1-3, the load conductor 202 is not directly connected to the bimetal 230. Rather, the second end 206 of the load conductor 202 is directly electrically connected to the second end 264 of the bypass heater element 260. Thus, the bypass heater element 260, in the embodiment of FIGS. 4-7, directs substantially all of the electric current so as to completely bypass the bimetal 230.

As respectively shown in the side elevation views of FIGS. 2 and 4, a common feature of both thermal trip assemblies 100 (FIG. 2), 200 (FIG. 4) is that the intermediate portions 166 (FIG. 2), 266 (FIG. 4), of the bypass heater 160 (FIG. 2), 260 (FIG. 4) of both embodiments include at least one offset bend 190 (FIG. 2), 290 (FIG. 4) to position a portion of bypass heater element 160 (FIG. 2), 260 (FIG. 4) parallel to and spaced from an opposing portion of the bimetal 130 (FIG. 2), 230 (FIG. 4). In addition, at least one of the bypass heater element 160 (FIG. 2), 260 (FIG. 4) and the load conductor 102 (FIG. 2), 202 (FIG. 4) includes a notched area adapted to facilitate bending for thermal calibration of the thermal trip assembly 100 (FIG. 2), 200 (FIG. 4). For example and without limitation, in the non-limiting example embodiment of FIG. 2 the bypass heater element 160 includes a notched area generally indicated by reference 192, and in the non-limiting example embodiment of FIG. 4 the bypass heater element 260 includes a notched area generally indicated by reference 292. Such notched areas (e.g., without limitation, 192,292) act as a hold point or pivot point for bending and movement of the bimetal (e.g., without limitation, 130,230) forward and backward (e.g., to the left and right from the perspective of FIGS. 2-5). These features (e.g. without limitation, offset bends 190, 290, and notched areas 192, 292) function to position the components of thermal trip assemblies 100, 200 as desired for optimal performance in accordance with the disclosed concept.

Accordingly, the disclosed concept provides a thermal trip assembly (e.g., without limitation, thermal trip assembly 100 of FIG. 1-3; thermal trip assembly 200 of FIGS. 4-7), which among other benefits, directs electric currently to at least partially bypass the bimetal 130 (FIGS. 1-3), 230 (FIGS. 4-7) of the assembly, as desired.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A thermal trip assembly for an electrical switching apparatus, said electrical switching apparatus including a housing, separable contacts enclosed by the housing, an operating mechanism for opening and closing said separable contacts, and a number of shunts, said thermal trip assembly comprising:

a load conductor;

a bimetal adapted to cooperate with said operating mechanism to open said separable contacts in response to a trip condition; and a bypass heater element structured to be electrically connected to said shunts, wherein said bypass heater element directs the flow of electric current to at least partially bypass said bimetal, wherein said bypass heater element comprises a first end, a second end distal from the first end, and an intermediate portion extending between the first end and the second end, wherein said load conductor comprises a first end, a second end distal from the first end, and an intermediate portion extending between the first end and the second end, wherein said bimetal comprises a first end and a second end disposed opposite and distal from the first end, wherein the second end of said load conductor is directly electrically connected to the second end of said bimetal; and wherein the second end of said bypass heater element is disposed proximate the second end of said bimetal and the second end of said load conductor but is not directly electrically connected to said load conductor, in order that said bypass heater element directs electric current to partially bypass said bimetal.

2. The thermal trip assembly of claim 1 wherein the first end of the bypass heater element extends perpendicularly outwardly from the intermediate portion of the bypass heater element to form a flange; and wherein said flange is structured to be electrically connected to said shunts.

3. The thermal trip assembly of claim 2 wherein the first end of said load conductor extends perpendicularly outwardly from the intermediate portion of said load conductor to form a flange; and wherein said flange of said load conductor is disposed in a direction opposite said flange of said bypass heater element.

4. The thermal trip assembly of claim 3 wherein said load conductor further comprises a thru hole extending through the intermediate portion of said load conductor; wherein said bypass heater element further comprises an aperture and an adjustment mechanism; wherein the aperture extends through the intermediate portion of said bypass heater element; and wherein said adjustment mechanism extends outwardly from the aperture of said bypass heater element and through the thru hole of said load conductor.

5. The thermal trip assembly of claim 4 further comprising a mounting element disposed between said bypass heater element and said load conductor; wherein said mounting element includes a threaded aperture; wherein said bypass heater element further comprises a first side and a second side disposed opposite the first side; wherein the aperture of the bypass heater element includes an enlarged portion and an elongated portion extending from the enlarged portion toward the second end of said bypass heater element; wherein said adjustment mechanism is a thermal calibration screw comprising a head portion, a threaded body portion, and a neck portion extending between said head portion and said threaded body portion; wherein said head portion is structured to extend through said enlarged portion of the aperture of the bypass heater element and be disposed on the first side of said bypass heater element; wherein said neck portion is structured to slide within said elongated portion of the aperture of the bypass heater element; and wherein said threaded body portion is adjustably secured within the threaded aperture of said mounting element on the second side of said bypass heater element.

6. The thermal trip assembly of claim 3 wherein said bimetal further comprises a trigger element disposed at or about the first end; and wherein, responsive to said trip condition, said bimetal is structured to bend in order that said trigger element cooperates with said operating mechanism to trip open said separable contacts.

7. The thermal trip assembly of claim 2 wherein the intermediate portion of said bypass heater element includes at least one offset bend to position a portion of said bypass heater element parallel to and spaced from an opposing portion of said bimetal.

8. The thermal trip assembly of claim 1 wherein at least one of said bypass heater element and said load conductor includes a notched area adapted to facilitate bending for thermal calibration of said thermal trip assembly.

9. An electrical switching apparatus comprising:

a housing;

separable contacts enclosed by the housing;

an operating mechanism for opening and closing said separable contacts;

a number of shunts; and a thermal trip assembly comprising:

a load conductor, a bimetal adapted to cooperate with said operating mechanism to open said separable contacts in response to a trip condition, and a bypass heater element electrically connected to said shunts, wherein said bypass heater element directs the flow of electric current to at least partially bypass said bimetal, wherein said bypass heater element comprises a first end, a second end distal from the first end, and an intermediate portion extending between the first end and the second end, wherein said load conductor comprises a first end, a second end distal from the first end, and an intermediate portion extending between the first end and the second end, wherein said bimetal comprises a first end and a second end disposed opposite and distal from the first end, wherein the second end of said load conductor is directly electrically connected to the second end of said bimetal; and wherein the second end of said bypass heater element is disposed proximate the second end of said bimetal and the second end of said load conductor but is not directly electrically connected to said load conductor, in order that said bypass heater element directs electric current to partially bypass said bimetal.

10. The electrical switching apparatus of claim 9 wherein the first end of the bypass heater element extends perpendicularly outwardly from the intermediate portion of the bypass heater element to form a flange; and wherein said shunts are electrically connected to said flange.

11. The electrical switching apparatus of claim 10 wherein the first end of said load conductor extends perpendicularly outwardly from the intermediate portion of said load conductor to form a flange; and wherein said flange of said load conductor is disposed in a direction opposite said flange of said bypass heater element.

12. The electrical switching apparatus of claim 11 wherein said load conductor further comprises a thru hole extending through the intermediate portion of said load conductor;

wherein said bypass heater element further comprises an aperture and an adjustment mechanism; wherein the aperture extends through the intermediate portion of said bypass heater element; and wherein said adjustment mechanism extends outwardly from the aperture of said bypass heater element and through the thru hole of said load conductor.

13. The electrical switching apparatus of claim 12 further comprising a mounting element disposed between said bypass heater element and said load conductor; wherein said mounting element includes a threaded aperture; wherein said bypass heater element further comprises a first side and a second side disposed opposite the first side; wherein the aperture of the bypass heater element includes an enlarged portion and an elongated portion extending from the enlarged portion toward the second end of said bypass heater element; wherein said adjustment mechanism is a thermal calibration screw comprising a head portion, a threaded body portion, and a neck portion extending between said head portion and said threaded body portion; wherein said head portion is structured to extend through said enlarged portion of the aperture of the bypass heater element and be disposed on the first side of said bypass heater element; wherein said neck portion is structured to slide within said elongated portion of the aperture of the bypass heater element; and wherein said threaded body portion is adjustably secured within the threaded aperture of said mounting element on the second side of said bypass heater element.

14. The electrical switching apparatus of claim 11 wherein said bimetal further comprises a trigger element disposed at or about the first end; and wherein, responsive to said trip condition, said bimetal is structured to bend in order that said trigger element cooperates with said operating mechanism to trip open said separable contacts.

15. The electrical switching apparatus of claim 10 wherein the intermediate portion of said bypass heater element includes at least one offset bend to position a portion of said bypass heater element parallel to and spaced from an opposing portion of said bimetal.

16. The electrical switching apparatus of claim 9 wherein at least one of said bypass heater element and said load conductor includes a notched area adapted to facilitate bending for thermal calibration of said thermal trip assembly.

* * * * *